US007677924B2

(12) United States Patent
Schuster et al.

(10) Patent No.: US 7,677,924 B2
(45) Date of Patent: Mar. 16, 2010

(54) HIGH CURRENT COAXIAL CONNECTION WITH TWO PLUG ELEMENTS, AND GRADIENT COIL CONDUCTOR

(75) Inventors: Johann Schuster, Oberasbach (DE); Stefan Stocker, Grossenseebach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/328,040

(22) Filed: Dec. 4, 2008

(65) Prior Publication Data

US 2009/0149064 A1 Jun. 11, 2009

(30) Foreign Application Priority Data

Dec. 11, 2007 (DE) ..... 10 2007 059 521

(51) Int. Cl.
*H01R 9/05* (2006.01)

(52) U.S. Cl. ..... 439/578

(58) Field of Classification Search ..... 439/578; 324/318

See application file for complete search history.

(56) References Cited

U.S. PATENT DOCUMENTS 2,439,841 A * 4/1948 Carsten et al. ..... 439/578
4,326,769 A * 4/1982 Dorsey et al. ..... 439/578
4,444,454 A * 4/1984 Horowitz ..... 439/578
5,435,745 A 7/1995 Booth
5,952,830 A * 9/1999 Petropoulos et al. ..... 324/318
6,379,183 B1 * 4/2002 Ayres et al. ..... 439/578
2003/0090268 A1 * 5/2003 Endt ..... 324/318
2004/0113618 A1 * 6/2004 Schuster ..... 324/318

FOREIGN PATENT DOCUMENTS

DE 296 08 939 U1 8/1996
DE 695 05 879 T2 6/1999

* cited by examiner

*Primary Examiner*—Briggitte R Hammond
(74) *Attorney, Agent, or Firm*—Schiff Hardin LLP

(57) ABSTRACT

A high-current coaxial connection with two plug elements that can be connected with one another, in particular to connect a current-carrying coaxial conductor to a gradient coil of a magnetic resonance apparatus, has a first and second coupling rings provided at the respective plug elements. The first coupling ring with a first thread is screwed onto one plug contact to be fixed to the plug element while the second coupling ring with a second thread that overlaps the first coupling ring, is screwed onto a mating thread section at the other plug element. Both coupling rings are rotationally locked relative to one another and the first thread and the second thread are different.

9 Claims, 1 Drawing Sheet

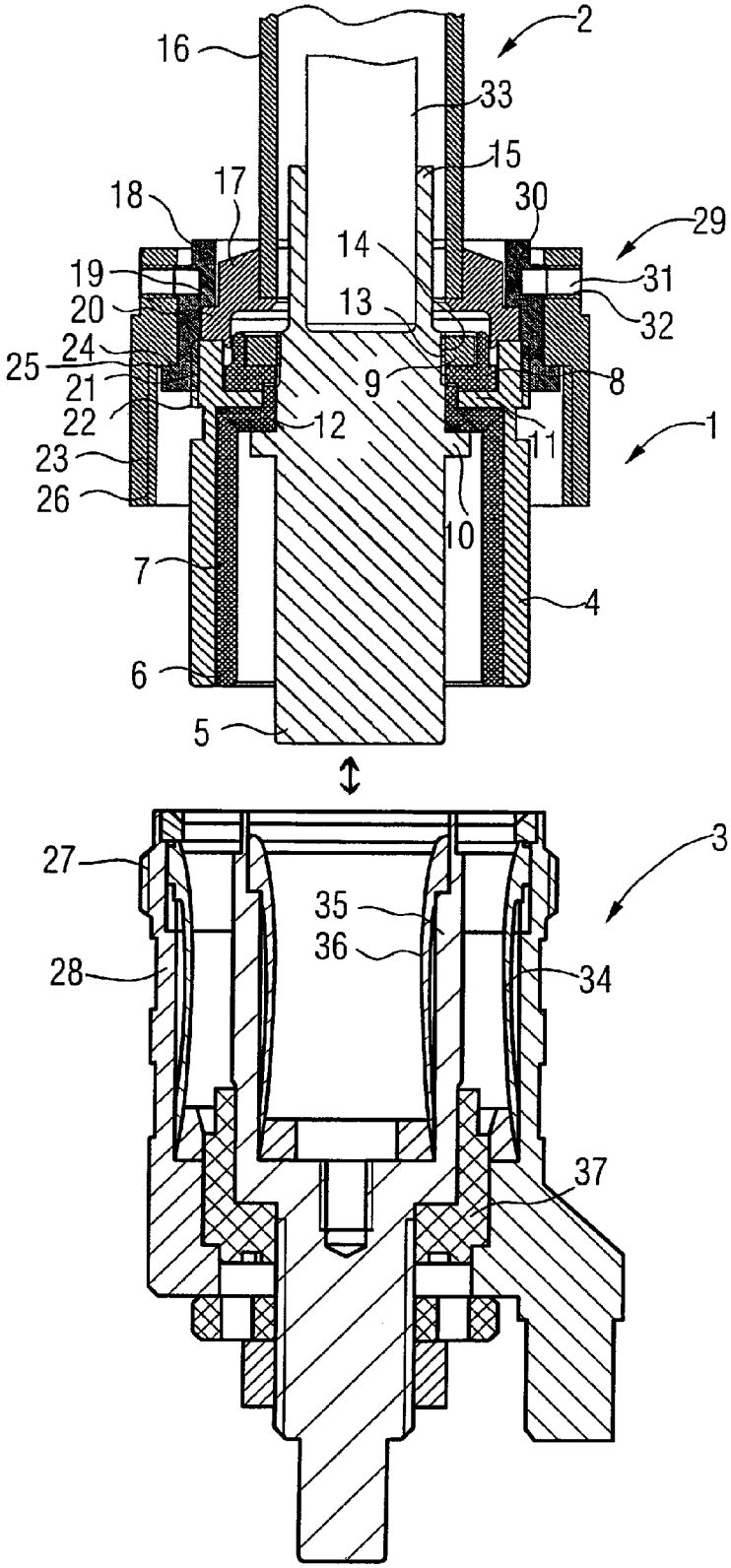
2
16
33
15
17
18
30
29
14
19
31
13
20
32
24
25
9
8
21
22
12
11
1
23
26
10
7
4
6
5
3
27
35
36
28
34
37

HIGH CURRENT COAXIAL CONNECTION WITH TWO PLUG ELEMENTS, AND GRADIENT COIL CONDUCTOR

BACKGROUND OF THE INVENTION

1. Field of the Invention

The present invention concerns a high-current coaxial conductor with two plug elements that can be connected with one another, in particular to connect a current-carrying coaxial conductor to a gradient coil of a magnetic resonance apparatus.

2. Description of the Prior Art

In magnetic resonance apparatuses an examination subject is exposed to a strong magnetic field to generate image exposures. This leads to an alignment of the nuclear spins of the atoms located in the magnetic field. The measurement signal for the imaging is obtained by the excitation of oscillations with radio-frequency energy. In order to obtain a spatial coding of the signals, magnetic gradient fields are used that are generated along the spatial directions with the use of gradient coils. The coils for the individual spatial directions are combined into a gradient coil system that has multiple individual coils respectively associated with the three spatial directions, and often also designated as a "gradient coil" for short. This gradient coil is spatially fixed in a casting compound in which it is sealed.

A high current must be supplied to the gradient coil to generate the gradient fields. The currents are several hundred amperes; for instance, currents of 500-900 A are typical.

Since no suitable high-current coaxial connection for connection of such a gradient coil has previously been available, it has been typical to split the coaxial line into two individual conductors before the connection to the coil, these two individual conductors then in turn being screwed down on the coil. The high current that must be supplied to the gradient coil therefore no longer flows coaxially in the connection region. Large alternating forces therefore occur in the stray field of the magnet, and therefore lead to a high, dynamic material strain due to the individual conductors. This entails the danger of a fracture or a loosening of the contact, which can cause a fire to start due to the large amount of energy at the gradient power amplifier (GPA).

In light of these problems, attempts have been made to produce the connection of the gradient coil by means of a high-current coaxial connection formed of two plug elements, namely a plug and a mating connector that can be detachably connected With the plug. The plug is located at the high-current coaxial conductor to be connected while the mating connector (thus the socket) is typically provided at the gradient coil (is permanently molded there). To connect, the plug is inserted into the mating connector. Both are naturally constructed so as to handle the high currents, namely the coaxial plug contacts are of approximate heavy-duty design and are insulated from one another. To hold the conductor-side plug to the coil-side mating connector, a coupling ring is provided that is screwed onto the mating connector. In principle, the possibility exists to realize a coaxial connection with such a high-current coaxial connection. Problems exist, in operation, however, because an unintended detachment of the plug connection can occur—due to mechanical vibrations and/or alternating electromagnetic forces at the individual plug elements or at the conductor-side plug contact—due to the coupling ring becoming detached due to the stresses (thus the fixed, threaded joint releases).

SUMMARY OF THE INVENTION

An object of the present invention is to provide a high-current coaxial connection in which an unintentional detaching of the plug elements connected with one another is precluded.

This object is achieved according to the invention by a high, current coaxial connector having first and second coupling rings respectively provided at the plug elements. The first coupling ring with a first thread is screwed onto a plug contact to be fixed to one plug element. The second coupling ring overlaps the first coupling ring and is screwed onto a mating thread section at the other plug element. Both coupling rings are rotationally locked relative to one another and the first thread and the second thread are different from each other.

In the high-current coaxial connection according to the invention, two interacting coupling rings are particularly advantageously used that are screwed in place with different elements. The first, inner coupling ring of the first plug element is screwed together with a plug contact, and this is fixed to the plug element via this screw connection. A first threaded connection is provided for this purpose. This first coupling ring is overlapped by a second coupling ring that is screwed onto the second plug element at the gradient coil; a second threaded connection serves for this. However, the two threaded connections are different, i.e. they differ in thread direction or thread pitch, for example. Furthermore, according to the invention both coupling rings are locked relative to one another, meaning that the one threaded ring cannot rotate relative to the other since both are mechanically coupled with one another.

This embodiment according to the invention now ensures that an unintentional detaching of the plug connection is precluded in any case, independent of the attacking forces. A rotation of the second, external coupling ring to release the screw connection is not possible since, as described, it is locked with the inner first coupling ring, thus is mechanically coupled, and a blocking movement of the inner coupling ring would occur as a result of the different thread on the inner first coupling ring. The same applies in the reverse case. This means that, as a result of the rotation locking or, respectively, mechanical movement coupling of the two coupling rings and the different thread, any even slight ring movement also leads to a self-locking of the combination of the two coupling rings.

According to a first alternative of the invention, the first thread can be a left-handed thread and the second thread can be a right-handed thread, or vice versa. This means that the winding directions are different. As a result of the movement coupling, a rotation of the outer ring would thus lead to an additional tightening of the inner coupling ring; as a result of the rotation locking or mechanical movement coupling, any ring movement is precluded as a result of this self-locking, even given the large forces present.

As an alternative to the use of different thread directions, it is also conceivable that the two threads possess different pitches. This embodiment of the invention likewise leads to a self-locking. For example, if the second thread on the outer second coupling ring possesses a larger pitch than the first thread of the first coupling ring, any movement of the outer coupling ring leads in turn to an even stronger bracing of the inner threading seat as a result of the smaller pitch of the thread of the inner coupling ring, since—as a result of the smaller pitch—these threaded connections cannot necessarily not track the larger axial movement path that the outer thread covers given a ring rotation. This different thread pitch in connection with the rotation locking or movement coupling of the two coupling rings also leads to a complete self-locking of the plug connection.

The rotation locking of the two coupling rings is appropriately a mechanical rotation locking. For example, this can be executed such that at least one radially directed recess is provided at the first coupling ring, in which recess a fixing element penetrating an opening at the second coupling ring engages. A radial connection between the two coupling rings thus occurs here that is naturally detachable in order to be able to release the coaxial connection again as needed. In an embodiment of the invention, the recess is appropriately executed as a circumferential groove in which a locking screw screwed into the opening engages, which locking screw forms the fixing element.

The plug contact to be held by the first coupling ring for mounting purposes is appropriately a cylindrical sleeve, and the first coupling ring connects the plug contact (via the screw connection) with an advantageously cylindrical connection element connected with an outer coaxial conductor and covered by the coupling ring. This connection element (a suitable connection ring) is connected with the outer coaxial conductor (typically in the form of a Cu tube) via a solder joint and is covered at a suitable collar [shoulder] seat by the coupling ring.

The plug contact itself is appropriately connected with a modular unit with an axial second plug contact and an insulator arranged between them, this modular unit being fixed by means of the first coupling ring. This is advantageous for installation reasons. This means that the entire contact structure composed of the sleeve-like first plug contact and the axially central second plug contact executed as a contact stub or pin, is executed as a prefabricated modular unit with an insulator arranged between the contacts. The insulator need merely be connected with the other elements of the plug element and screwed down over the coupling rings for assembly.

In order to be able to connect the two plug contacts with one another into a modular unit in a simple manner, the second stud-like, axially central plug contact appropriately exhibits a bearing shoulder projecting radially outwardly, and the first plug contact exhibits a bearing shoulder projecting radially inwardly, with a thread segment onto which a retaining nut is screwed being provided at the second plug contact. This retaining nut axially braces the insulation and the bearing shoulders against one another. The insulation, which naturally is also arranged between the two bearing shoulders, is permanently fixed by this retaining nut; the two plug contacts are also simultaneously firmly connected with one another.

The invention furthermore concerns a gradient coil with connected high-current coaxial conductor as part of a magnetic resonance apparatus, characterized by the connection being produced by a high-current coaxial connection of the type described above. The one plug element (advantageously the plug element with the two coupling rings) is arranged on the coaxial conductor to be connected while the second plug element (thus the socket) is positioned at the gradient coil. This can occur via casting or lamination.

BRIEF DESCRIPTION OF THE DRAWING

The single figure is a section through an embodiment of a high-current coaxial connection constructed in accordance with the present invention.

DESCRIPTION OF THE PREFERRED EMBODIMENTS

In the drawing a high-current coaxial connection according to the invention is shown, consisting of a first plug element 1 that is arranged on a coaxial conductor 2 to be connected and forms the plug, as well as a second plug element 3 forming the mating connector. The plug element 3 is arranged at a gradient coil (cast or laminated there) and is connected with downstream operating components. To connect, the two plug elements 1 and 3 are plugged into one another and are screwed together with one another by a coupling ring (described in further detail), as discussed below.

The first plug element 1 has a first plug contact 4 in the form of a cylindrical sleeve as well as an axially central pin-shaped or stub-shaped second plug contact 5 arranged inside the first sleeve-like plug contact 4. Both are insulated from one another via an insulation 6 (likewise cylindrical in shape). The plug contacts 4, 5, together with the insulation 6 (consisting of a cylindrical insulating body 7 and an additional annular insulating body 8) are connected to a prefabricated modular unit by means of a retaining nut 9. A radially projecting bearing shoulder 10 is fashioned at the central second plug contact 5; a bearing shoulder 11 radially branching inward is fashioned at the outer, sleeve-like first plug contact. For assembly, the sleeve-like insulating part 7 is first inserted into the sleeve-like first plug contact 4 until it strikes the bearing shoulder 11. The second insulating part 8 is then placed from the other side, and the central, stud-like plug contact 5 is subsequently inserted until the shoulder 10 strikes against the radial segment 12 of the insulating part 7. An outer thread 13 onto which the nut 9 with its inner thread 14 is screwed is provided at the central plug contact 5. All elements are embodied into a contact module.

In order to now connect the two plug contacts 4, 5 with the corresponding contact parts of the coaxial conductor 2, an inner stranded cable 14 of the coaxial conductor 2 is inserted into the hollow cylindrical receptacle segment 15 of the second plug contact 5 and is soldered with this. The conductor contact to the central plug contact 5 is thereby produced.

The outer contact of the coaxial conductor 2 is then to be produced in the form of a Cu tube 16 with the first plug contact 4, for example. For this purpose, the Cu tube (which can move axially relative to the inner stranded cable 33) is firmly connected at its end with an annular connection element 17 via a solder connection. In the mounted position, the annular connection element 17 sits on the top side of the ring edge of the first plug contact 4. For fixing, a first coupling ring 18 is provided that has a radial shoulder 19 projecting inward which covers a radial shoulder 20 of the connection element 17 that projects outward. The coupling ring 18 has a first inner thread 21 that is screwed onto an outer thread 22 at the plug contact 4. The coupling ring 18 is very firmly screwed on in order to ensure a fixed, secure connection seat of the connection element 17 on the plug contact 4.

A second coupling ring 23 that covers the outside of the first coupling ring 18 serves for fixing the first plug element 1 on the second plug element 3. The second coupling ring 23 possesses an inwardly projecting radial shoulder 24 that, in the installed position, covers an outwardly projecting radial shoulder 25 of the first coupling ring 18. The second coupling ring 23 is screwed by a second inner thread 16 onto an outer thread 27 of an outer sleeve 28 on the second plug element 3.

To realize a self-locking action of the two coupling rings 18 and 23 against one another, the two threaded connections between the first coupling ring 18 and the first plug contact 4 and between the second coupling ring 23 and the outer sleeve 28 are on the one hand different. The inner thread 21 of the first coupling ring 18 is advantageously a left-handed thread (naturally corresponding to the outer thread 22 at the plug contact 4) while the inner thread 26 of the second coupling ring is a right-handed thread (corresponding to the outer thread 27 of the outer sleeve 28). This means that the two coupling rings are to be screwed on or, respectively, detached with different rotation directions.

Furthermore, a mechanical rotation lock 29 between the two threaded nuts 18, 23 is provided. This mechanical rotation lock has a circumferential groove 30 on the first coupling ring 18 that radially opens outward. Multiple openings 31 with an inner threading 32 (advantageously distributed equidistantly around the circumference) are provided on the second coupling sleeve 23. When the plug elements 1 and 3 are connected with one another (thus when the second coupling ring 23 is firmly screwed onto the outer sleeve 28), fixing elements (not shown here) in the form of locking screws (stud [headless] screws) that engage with their front (advantageously acute) end in the circumferential groove 30 engage in these openings 31. The two coupling sleeves 18 and 23 are thereby mechanically connected with one another, thus are movement-coupled and ultimately are axially fixed to one another and axially locked thereby. This mechanical connection (which naturally can be released again by unscrewing the locking screws to detach the entire plug connection), in connection with the dissimilarity of the two threaded connections between the coupling ring 18 with the first plug contact 4 or, respectively, the second coupling ring 23 with the outer sleeve 28, enables a complete self-locking of the plug element connection that does not unintentionally release even upon application of large or intense forces. Any movement of one of the coupling rings 18 or 23 around the rotation axis (thus along its thread) is suppressed as a result of the mechanical connection via the locking screws. A possible entrainment of the respective other ring is precluded because this is not possible as a result of the thread difference, because the rotation of the one coupling ring in its thread direction to detach the threaded connection would lead to a further screwing down of the other coupling sleeve in the same rotation direction. Both coupling sleeves thus mutually brace themselves via the selected rotation lock 29.

The outer sleeve 28 forms a contact of the plug elements 3. Contact terminals 34 are provided on its inner side that are pushed outward from the first plug contact when the plug element 1 is inserted, thus offer a good electrical contact. Upon connection of the plug contacts 1, 3, the second plug contact 5 of the first plug element 1 engages in an inner sleeve 35 forming a contact of the second plug element 3, on the inner side of which inner sleeve 35 are likewise provided contact terminals 36 that rest firmly on the outside of the stud-shaped plug contact 5 after the insertion. The outer sleeve 28 and the inner sleeve 35 are insulated from one another by an insulation 37.

Alternatively, it is possible to not execute the two threaded connections differently, right-handed and left-handed, but rather to execute them with different pitch. This would have a similar self-locking effect because the rotation of a coupling ring always leads to an even tighter, axially directed bracing of the thread edges (now resulting from the pitch difference) as a result of the different pitch of the threaded connection of the other coupling ring.

Although modifications and changes may be suggested by those skilled in the art, it is the intention of the inventors to embody within the patent warranted hereon all changes and modifications as reasonably and properly come within the scope of their contribution to the art.

We claim as our invention:

1. A high-current coaxial connection comprising:

a first plug element and a second plug element that mechanically mates with said first plug element, said first plug element being connected to a first part of a current-carrying coaxial conductor and said second plug element being connected to a second part of said current-carrying coaxial conductor;

first and second coupling rings respectively mounted at said first and second plug elements;

said first coupling ring having a first thread and being screwed onto a plug contact that fixes said first coupling ring to said first plug element;

said second coupling ring having a second thread and overlapping said first coupling ring, and being screwed with said second thread onto a mating thread section at said second plug element; and each of said first and second coupling rings being rotationally locked relative to each other and said first thread and said second thread being different.

2. A high-current coaxial connection as claimed in claim 1 wherein said first thread is a left-handed thread and said second thread is a right-handed thread.

3. A high-current coaxial connection as claimed in claim 1 wherein said first thread has a first pitch and said second thread has a second pitch different from said first pitch.

4. A high-current coaxial connection as claimed in claim 1 comprising a mechanical rotation lock that rotationally locks said first and second coupling rings relative to each other.

5. A high-current coaxial connection as claimed in claim 4 wherein said first coupling ring has at least one radially extending recess in which a fixing element, penetrating an opening in the second coupling ring, is engaged.

6. A high-current coaxial connection as claimed in claim 5 wherein said recess is formed by a circumferential groove in which a retaining screw is screwed into said opening.

7. A high-current coaxial connection as claimed in claim 1 wherein said second plug contact comprises a cylindrical sleeve and a first coupling sleeve connecting said cylindrical sleeve to a connection element that is connected to an outer coaxial conductor of said first portion of said current-carrying coaxial conductor.

8. A high-current coaxial connection as claimed in claim 1 wherein said first plug contact comprises a centrally axially disposed stub and an insulator spaced from and surrounding said stub, forming a modular unit that is fixed by said first coupling ring.

9. A high-current coaxial connection as claimed in claim 8 wherein said second plug contact comprising a bearing shoulder that projects radially outwardly, and wherein said first plug contact comprises a bearing shoulder that projects radially inwardly, and comprising a thread segment on which a retention nut is screwed at said second plug contact, said retention nut axially bracing said insulation and said inwardly and outwardly radially projecting bearing shoulders against each other.

* * * * *